US007014284B2

(12) United States Patent
Morton et al.

(10) Patent No.: US 7,014,284 B2
(45) Date of Patent: Mar. 21, 2006

(54) AMMUNITION HAVING SURFACE INDICIA AND METHOD OF MANUFACTURE

(76) Inventors: William (Bill) Morton, Box 2429, Cardston, Alberta (CA) T0K 0K0; Jay Menefee, 355 Riverdale Rd., Macon, GA (US) 31204; Andrew (Andy) Resko, 1635 Lakes Pkwy., Suite A, Lawrenceville, GA (US) 30043

( * ) Notice: Subject to any disclaimer, the term of this patent is extended or adjusted under 35 U.S.C. 154(b) by 232 days.

(21) Appl. No.: 10/757,491

(22) Filed: Jan. 15, 2004

(65) Prior Publication Data

US 2004/0169690 A1 Sep. 2, 2004

Related U.S. Application Data

(60) Provisional application No. 60/440,375, filed on Jan. 16, 2003.

(51) Int. Cl.
*B41F 17/20* (2006.01)

(52) U.S. Cl. ..... 347/4

(58) Field of Classification Search ..... 347/4; 42/1.01

See application file for complete search history.

(56) References Cited

U.S. PATENT DOCUMENTS 4,384,518 A * 5/1983 Albin ..... 101/40
4,401,032 A * 8/1983 Albin ..... 101/363
5,121,693 A 6/1992 Kosteck
5,147,495 A 9/1992 Douglas
5,296,081 A 3/1994 Morin et al.
5,521,655 A 5/1996 Rhoad
5,831,641 A 11/1998 Carlson
5,893,016 A 4/1999 Landa et al.
5,962,368 A 10/1999 Poole
6,092,890 A * 7/2000 Wen et al. ..... 347/101
6,098,689 A 8/2000 Fiwek
6,293,204 B1 9/2001 Regen
6,526,880 B1 3/2003 Coningsby
6,536,346 B1 * 3/2003 Niestrath ..... 101/489
6,538,767 B1 3/2003 Over et al.
6,550,389 B1 4/2003 Goto et al.
6,570,600 B1 5/2003 Aroneo et al.
6,578,276 B1 6/2003 Patton et al.
6,582,047 B1 6/2003 Koitabashi et al.
6,584,894 B1 7/2003 Mason
6,672,219 B1 * 1/2004 Mackerell et al. ..... 102/467

FOREIGN PATENT DOCUMENTS

EP 0017316 10/1980
EP 0689992 1/1996

* cited by examiner

*Primary Examiner*—K. Feggins
*Assistant Examiner*—Rene Garcia, Jr.
(74) *Attorney, Agent, or Firm*—Sean W. Goodwin; Linda M. Thompson

(57) ABSTRACT

Ammunition, such as shotshells used in waterfowl hunting, have indicia applied to substantially all of the external surface to reduce glare normally a problem in conventional ammunition. The indicia, such as a camouflage pattern, is applied either through the use of inkjet printing directly on the shotshell surface or through the application of a heat transfer sleeve to which the indicia has been previously applied. The process of applying the camouflage pattern may be incorporated into the manufacture of the ammunition or may be operable as a standalone process used for pre-manufactured ammunition.

23 Claims, 14 Drawing Sheets

AMMUNITION HAVING SURFACE INDICIA AND METHOD OF MANUFACTURE

CROSS REFERENCE TO RELATED APPLICATION

This application claims priority of U.S. Provisional application 60/440,375, filed Jan. 16, 2003, the entirety of which is incorporated herein by reference.

FIELD OF THE INVENTION

The present invention relates to ammunition and more particularly to camouflaged shotshells used in waterfowl hunting and methods of manufacture.

BACKGROUND OF THE INVENTION

The sport of waterfowl hunting is a highly popular sport throughout North America with hundreds of millions of dollars being spent on equipment, permits and ammunition each year.

One problem faced by all waterfowl hunters is that of glare. Glare from equipment, clothing, glasses and ammunition is sufficient to alert and alter the course of waterfowl, keeping them out of the range of hunters.

One cannot underestimate the degree to which hunters will go to ensure that glare is reduced. One solution employed in almost all hunting equipment today is the use of camouflage to reduce glare. Clothing, gun stocks and barrels, face masks, duck and goose calls and blinds are all disguised with a variety of camouflage patterns. The use of non-reflective decoys adds to further glare reduction.

Ammunition used in shotguns for waterfowl hunting is a shotshell. The shotshell has a brass hull and a polyethylene or paper case which fits into the hull. A primer is seated in the hull and a powder charge is placed into the hull. A wad is placed over the powder and a load of shot is then added to the case. The open end of the case is then sealed either by crimping or by a plastic disc placed inside a rim at the top end of the case. Optionally, a top wad may be placed over the shot before the case is closed.

Typically, manufacturers make the cases of the shotshell using brightly colored plastics and the brass hull is left exposed, both of which add to the shells visibility and glare. This is especially a problem when hunters shoot multiple shells each time a flock of birds flies over and the shells accumulate on the ground. There may be little time between successive flights of birds to attempt to both pick up birds which have been killed and pick up spent shell casings, which are ejected several feet away from a hunting blind. More effort is made to collect the birds and therefore the shell casing are likely to amass in large quantities around each hunting blind.

Many of the shotshell cases are slightly corrugated providing a non-smooth surface and the polyethylene used to make most modern cases has a natural greasiness which resists printing with many inks or paints. Both of these features result in a poor surface on which to print any type of patterns or non-reflective coating.

U.S. Pat. No. 4,384,518 to Albin and owned by Remington Arms Company Inc., describes a dry offset printer for cylindrical objects and particularly for use in printing onto shotshell cases. The process utilizes a three-roller system which includes ink, plate and blanket rolls, the blanket roller being a relatively soft elastomeric for printing onto corrugated shell cases. Applicant has noted that shells cases which are currently printed with manufacturer or distributor information are prone to loss or flaking of the printing off of the shell case as shotshells are carried in ammunition belts or loaded into guns.

Tolerances within the gun breach must be considered when adding any additional matter to the diameter of a shotshell, to prevent jamming during discharge of the gun and potential injury to the hunter.

Shotshells can be loaded manually or can be assembled in a highly automated process. Shotshells are produced in a plurality of lengths and also in a plurality of gauges. Because of the explosive nature of the product, the automated process must meet stringent safety requirements and must also meet rigid quality control standards due to a narrow range of acceptable size tolerances. Current printing processes are typically integrated into the automated process. Any process for providing indicia on the surface of the shotshell should be capable of full integration into an assembly line-type manufacture process and should not alter the effective diameter significantly to prevent jamming during discharge.

In some cases it may be advantageous to provide additional waterproofing or water resistance to the shotshell to ensure that the powder and primer remain active when in use especially in a highly aqueous environment such as found in natural wetlands. Shotshells will not properly fit into the breach of the shotgun if swelling occurs as a result of water penetration.

Significant efforts have been made by shotshell manufacturers to create water resistant shot wads as well as crimping techniques or seals at the open end of the case after loading of the shot and optionally, a water resistant or waterproof top wad. In some cases leakage into the shell case remains a problem. Further, compounds used to coat a shotshell after production are often messy or sticky to handle and may add irregularly to the diameter of the shotshell case causing problems with tolerances in the gun breach.

There is clearly a need to provide a shotshell that does not glare and more preferably that is camouflaged to suit a hunting environment so as not to be noticed by waterfowl within range of the hunter. Preferably, the shotshell should be water resistant if not waterproof for use in wetland situations or in inclement weather.

BRIEF DESCRIPTION OF THE DRAWINGS

FIG. 5*a* illustrates printing cases and hulls prior to assembly and loading, and FIG. 5*b* illustrates cases and hulls assembled prior to printing and alternatively loaded prior to or following printing of the assembled cases and hulls;

FIG. 12*a* is a perspective view of a preprinted heat transfer sleeve being positioned over a shotshell;

FIG. 12*b* is a perspective view according to FIG. 12*a* wherein the heat transfer sleeve has being positioned for bonding to the shotshell; and FIG. 12*c* is a perspective view according to FIG. 12*b* wherein the heat transfer sleeve has been bonded to the shotshell.

SUMMARY OF THE INVENTION

Figure 1:
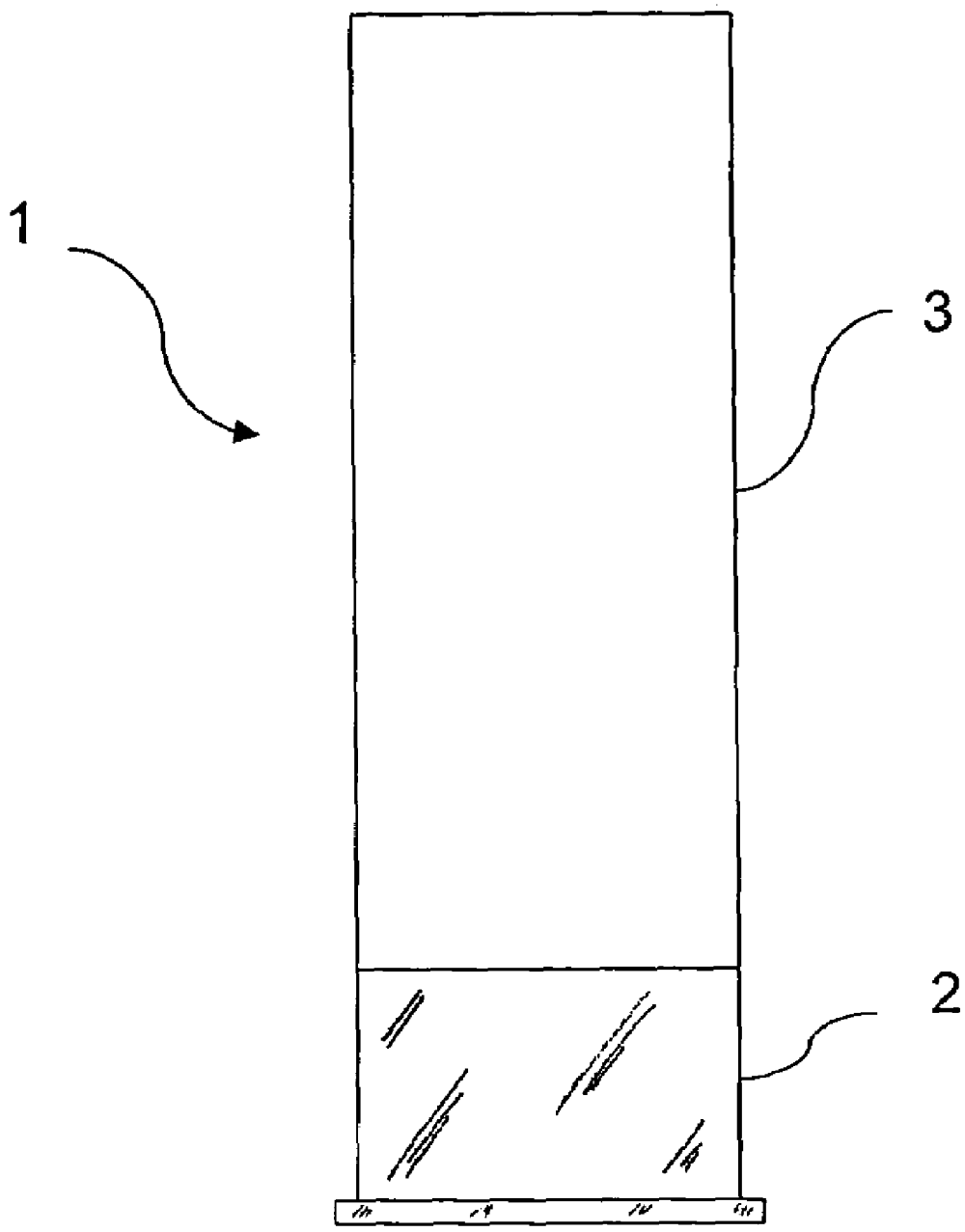
Fig. 1 PRIOR ART
FIG. 1 is a side view of a prior art shotshell illustrating a hull and a case of the shotshell.

In one aspect of the invention, camouflaged ammunition is produced by the application of indicia to substantially the entire outer surface of the ammunition. In the case of shotshells used for waterfowl hunting, a non-reflective camouflage indicia renders the ammunition substantially invisible to the waterfowl. Preferably the indicia resembles the environment in which the ammunition is to be used, such as but not limited to, a stubble field, a wetland marsh or prairie grass. The indicia acts to disrupt the outline of the ammunition on the ground making it difficult to see and preferably reduces glare therefrom.

In a broad aspect of the invention, ammunition having a substantially cylindrical outer surface comprises indicia applied to substantially the entire outer surface of the ammunition.

More particularly, the indicia is a non-reflective camouflage pattern which covers substantially the entire outer surface of the ammunition, any remaining outer surface, such as a metal hull or a portion thereof, being covered with a non-glare ink.

The indicia is either applied directly to substantially the external surface of cylindrical ammunition using an inkjet printing process or by applying the indicia to a heat transfer sleeve which is then applied to the ammunition using conventional heat transfer apparatus. The ammunition is first provided and oriented about it's axis and then the indicia is applied to substantially the entire outer surface. The application of the indicia can be incorporated into the process of manufacturing the ammunition or it can be done after manufacture, such as to pre-manufactured ammunition. When incorporated into a manufacturing process, the indicia can be applied separately to cases and hulls in the case of ammunition such as shotshells or it can be applied to assembled cases and hulls, either before or after loading and closing.

In an embodiment of the invention, apparatus is provided for applying indicia using inkjet printing on an external surface of cylindrical ammunition having an axis. The apparatus comprises a plurality of inkjet print heads for spraying preprogrammed indicia on the ammunition, a conveyor having means for rotatably carrying a plurality of cylindrical ammunition thereon the ammunition being rotated about the ammunition's axis while traversing the plurality of inkjet print heads for printing the preprogrammed indicia thereabout and a controller for causing the pre-programmed indicia to be sprayed on the ammunition as the ammunition is rotated.

Preferably, the means for rotatably carrying the ammunition on the conveyor is a plurality of spindles which are attached to bases rotatably connected to the conveyor belt. The bases may be rotated by a drive belt situated adjacent the conveyor belt and which engages the base. The drive belt is driven in a direction opposite to that of the conveyor to cause rotation the the bases and spindles. Alternatively, the bases may be geared pinions which engage teeth in a rack positioned adjacent the conveyor belt, the ratio of the teeth and the gears causing the bases and spindles to rotate.

Alternatively, in the case of pre-manufactured ammunition, the means for engaging the ammunition to the conveyor may be gripper means, magnetic means or sandwiching means, all connected rotatably to the conveyor for rotating the ammunition as it passes a plurality of inkjet print heads The inkjet print heads are positioned adjacent the conveyor and are controlled by the controller, such as a computer, to spray the indicia onto the rotating ammunition. Typically, at least three inkjet print heads, one for yellow, one for cyan and one for magenta, are required to complete the camouflage pattern. Preferably, UV curable ink is used and a UV source is housed along the conveyor for curing the ink onto the ammunition once it has passed the print heads. Alternatively, the ammunition is pre-treated using a corona treatment which enhances adhesion to the surface of the ammunition prior to printing using solvent-based inks which do not require curing. Ammunition is removed from the conveyor and is directed to be loaded or closed and then packaged, or in the case of pre-manufactured ammunition is directed for packaging.

DESCRIPTION OF THE PREFERRED EMBODIMENT

Embodiments of the invention are described herein relative to a shotshell, however, one skilled in the art would understand that the invention may be applied to other cylindrical ammunition, shell casings, munitions and the like, which may require indicia to be printed on the surface and, more particularly, a camouflage pattern printed on a substantial portion of the exterior surface.

A prior art shotshell 1, as shown in FIG. 1, has a reflective metal hull 2 and typically, a colored plastic case 3. Shotshells of this type are problematic due to glare which scares away waterfowl, especially when the shotshells 1 are present in large quantities, such as outside a hunting blind.

Figure 2:
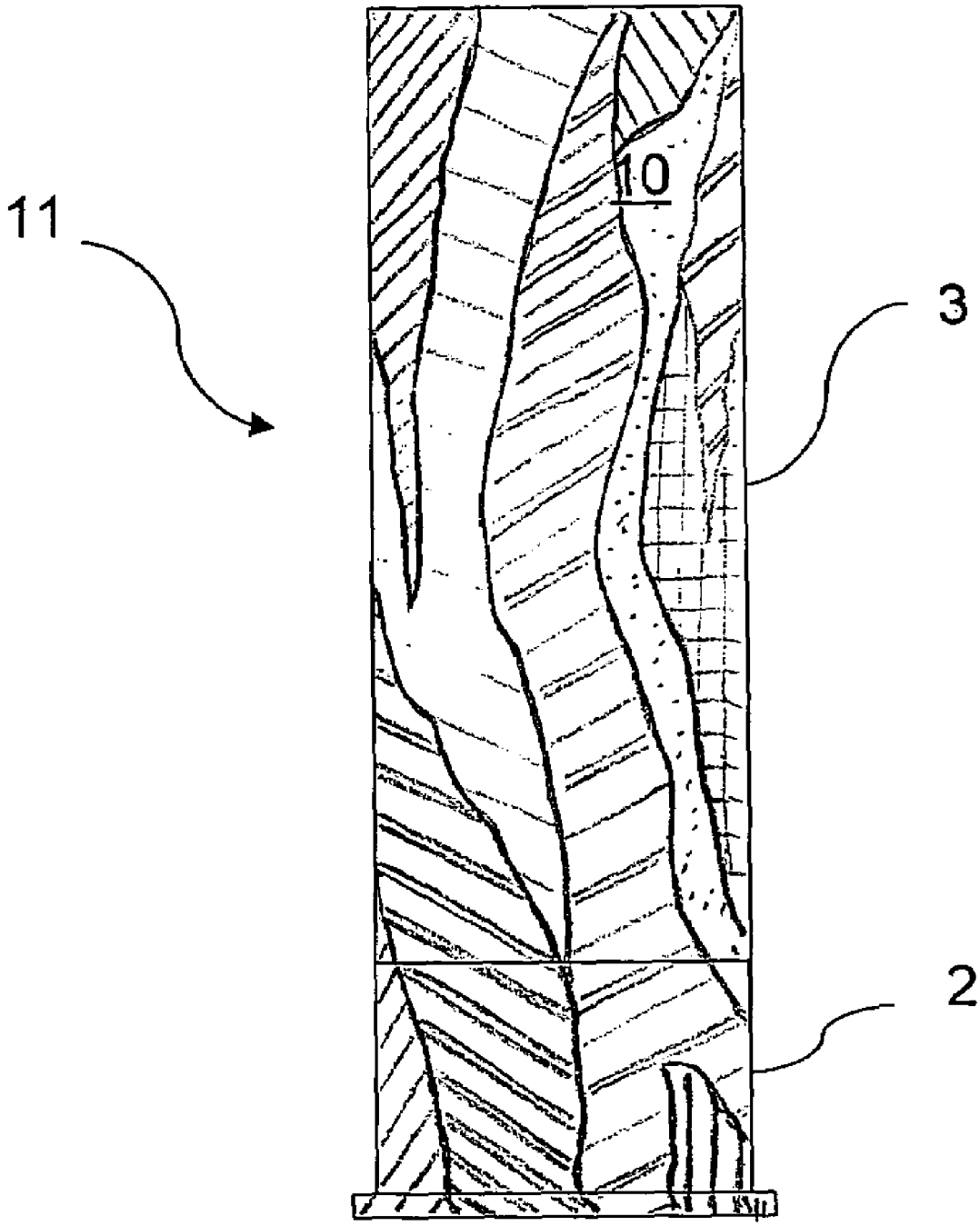
FIG. 2 is a side view of a shotshell according to FIG. 1 having camouflage indicia printed on the external surface of the shotshell according to one embodiment of the present invention.
Figure 3:
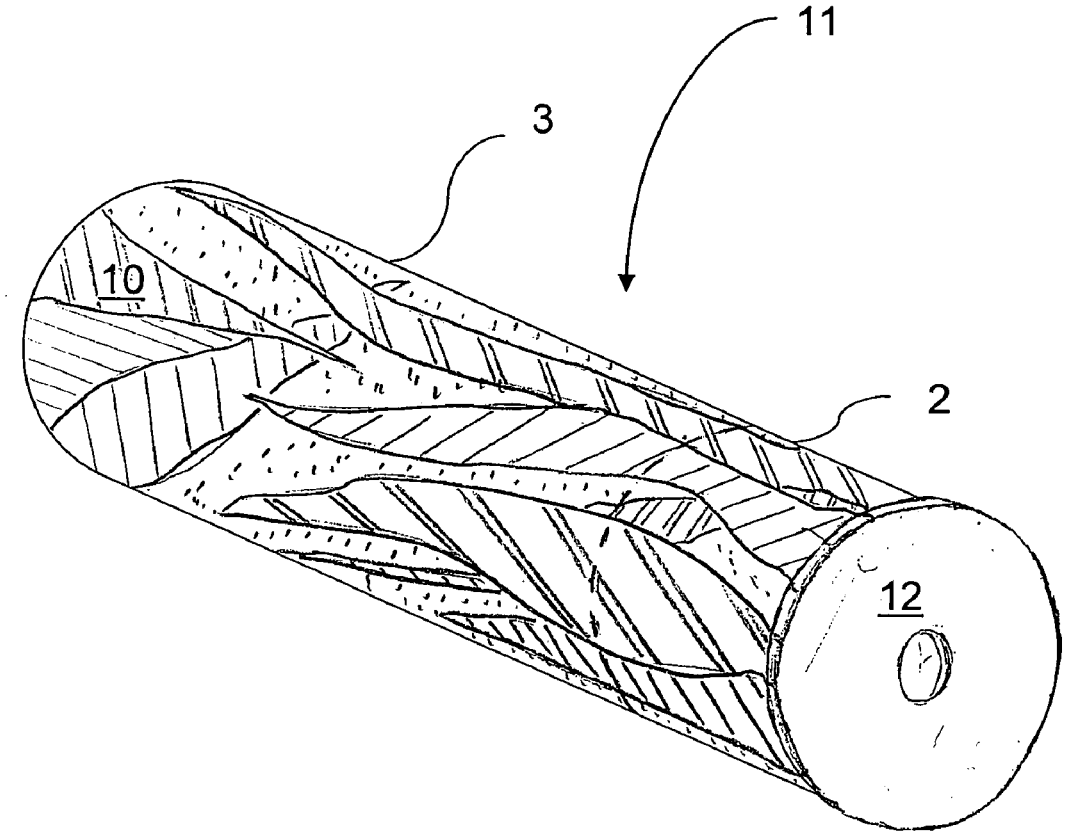
FIG. 3 is a bottom perspective view of a shell according to FIG. 2, the bottom of the shotshell having been sprayed with a non-glare ink.
Figure 4:
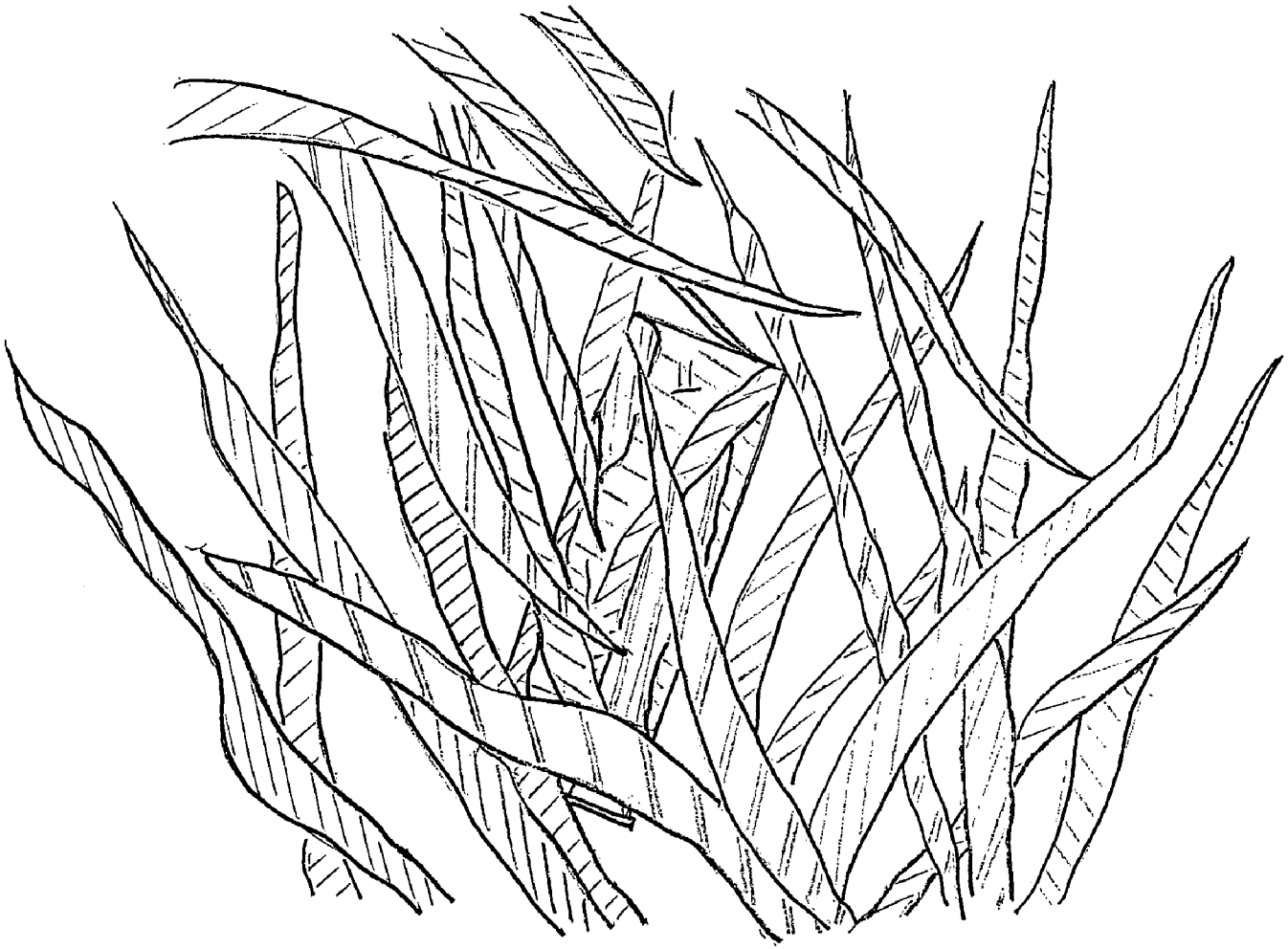
FIG. 4 is a fanciful illustration of a shotshell of the present invention camouflaged in a hunting environment.

In an embodiment of the invention, as shown in FIGS. 2–4, an outside surface 10 of the shotshell 11 is covered or imprinted with indicia that reduces the glare from the case 3 and/or hull 2 and allows it to be camouflaged in a particular environment. A number of different camouflage patterns, including registered, copyrighted patterns such as Camoshell™ (U.S. VAu 592-548), incorporated herein by reference, or similar indicia, may be used on the outer surface 10 of the shotshell 1 to permit the camouflaged shotshell 11 to be hidden in a wetland marsh, stubble fields, snow covered fields or other waterfowl environments (FIG. 4).

The pattern is imparted to the outer surface 10 of the shotshell 1 in such a manner so as to make the indicia relatively permanent and not easily removed by wear and tear. Techniques are employed that result in a reliable, non-smearing printing of the pattern onto the surfaces 10 of both the typically metal hull 2 and the plastic or paper of the case 3.

Further, the addition of the printing or film to the outside surface 10 of the shotshell 1 is sufficiently thin so as to avoid changing a diameter of the printed shotshell 11 significantly, permitting fit within allowable tolerances within a gun breach and does not affect the firing surface of the shotshell 11.

Figure 5A:
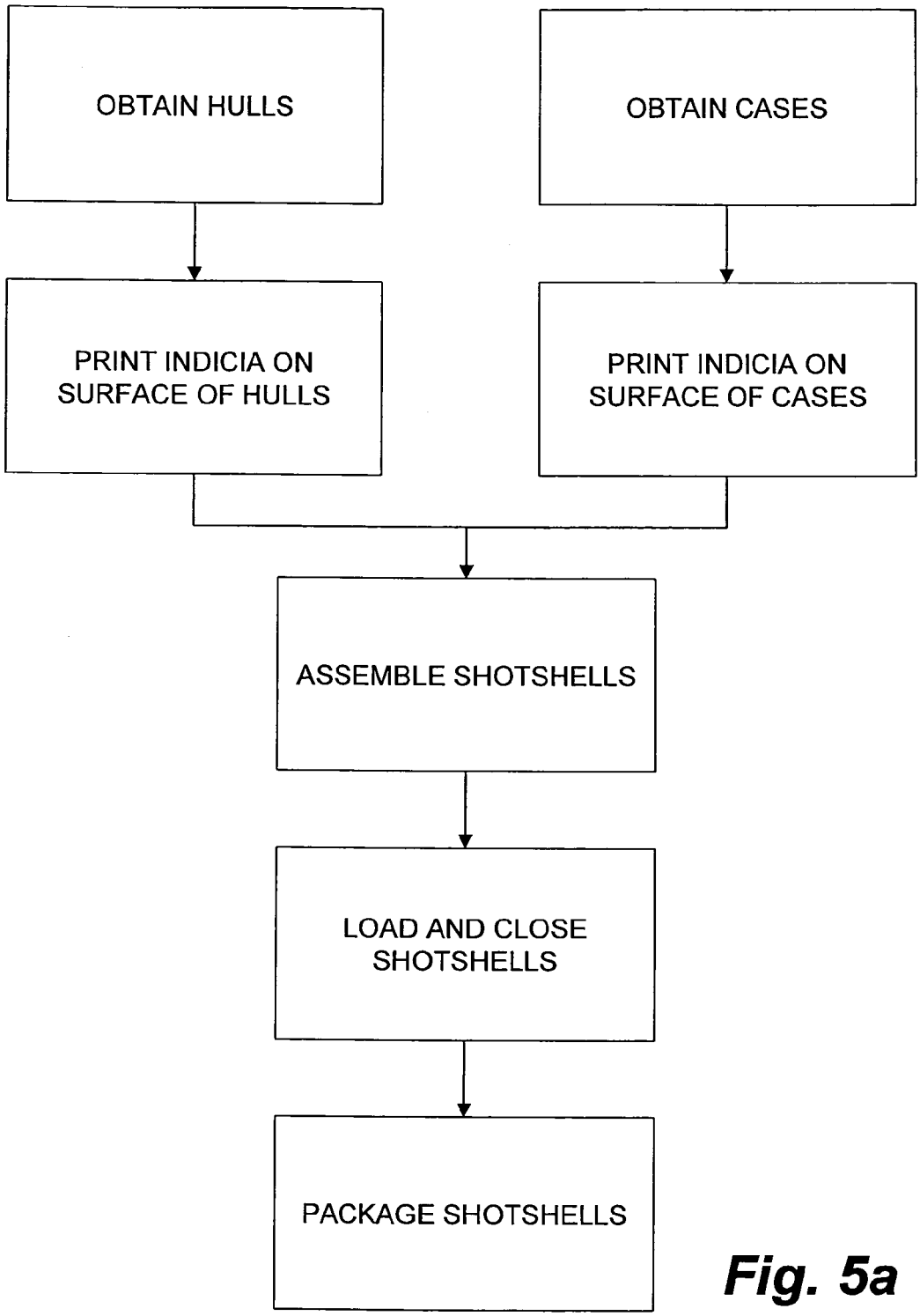
FIGS. 5*a*–5*b* are flowcharts illustrating the incorporation of one embodiment of a printing process into a shotshell manufacturing assembly line, more particularly.
Figure 5B:
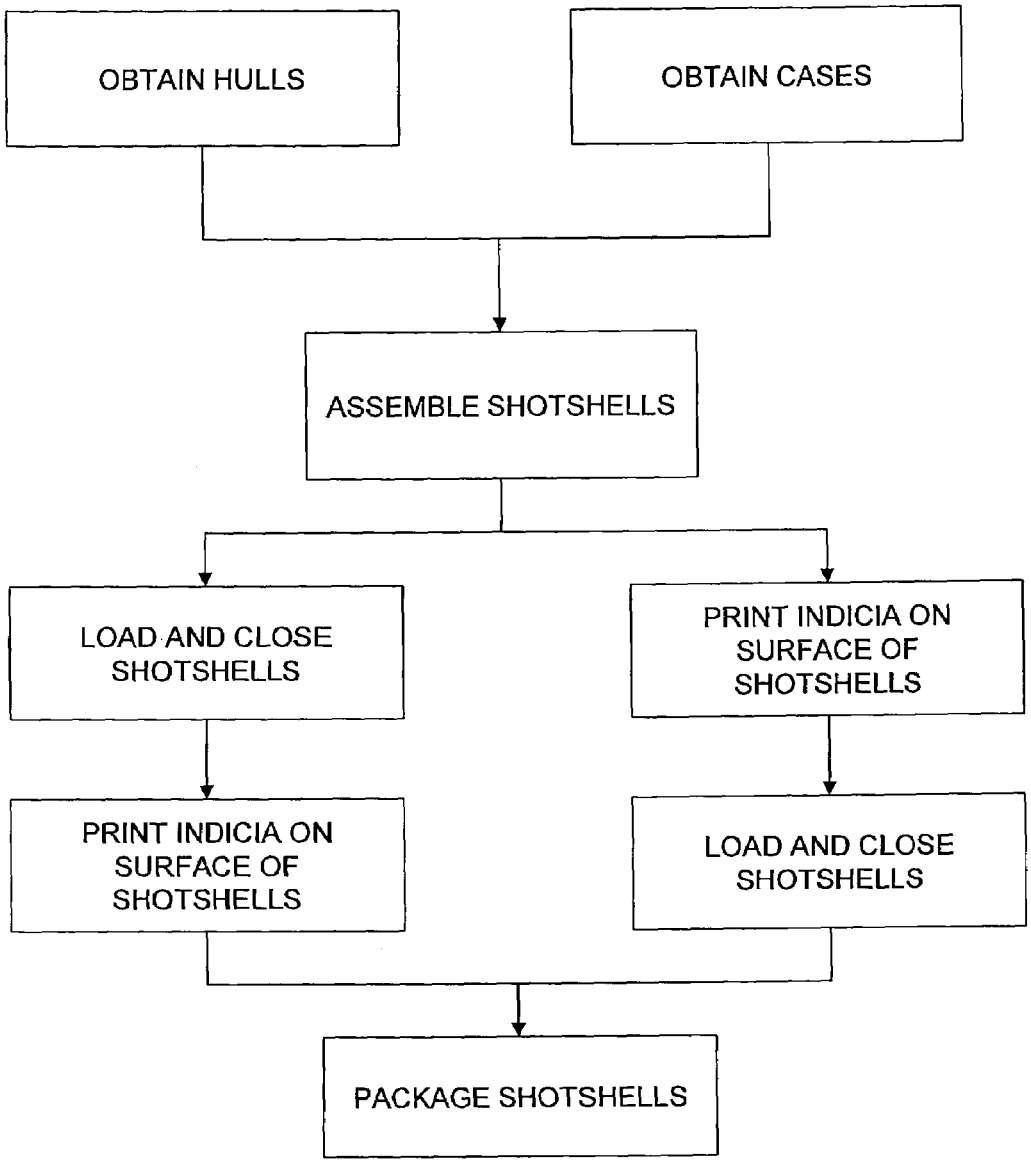

As shown in FIGS. 5*a* and 5*b*, the printing process can be incorporated at different stages of the manufacturing process. The addition of the camouflage indicia to the outer surface 10 of the shotshell 1 can be performed as an integral part of the shotshell 1 manufacture by incorporation of a printing module into the production stream of existing automated shotshell manufacturing processes. Printing may be done immediately prior to a packaging portion of the process or, more preferably, prior to loading the assembled case 3 and hull 2.

Having reference to FIG. 5*a*, indicia is imparted separately to the hull 2 and case 3 prior to assembly, loading and packaging. In FIG. 5*b*, the hull 2 and case 3 are assembled in a first step. Two alternate processes are shown, one in which the assembled shotshells 1 are first printed and then loaded and a second wherein the assembled shotshells 1 are first loaded and then printed. In both cases the final step is packaging of the camouflaged shotshells 11.

Alternatively, pre-manufactured and packaged shotshells 1 can be unpackaged and added to a standalone printing module to allow the already manufactured shotshells 1 to be camouflaged in a post-production operation. A re-packaging process is typically added following printing.

Optionally, indicia added to the outer surface 10 of a shotshell 1 can include already known camouflage patterns, newly designed patterns customized for specific environments and may also include logos or other information of interest to the hunter.

Figure 6:
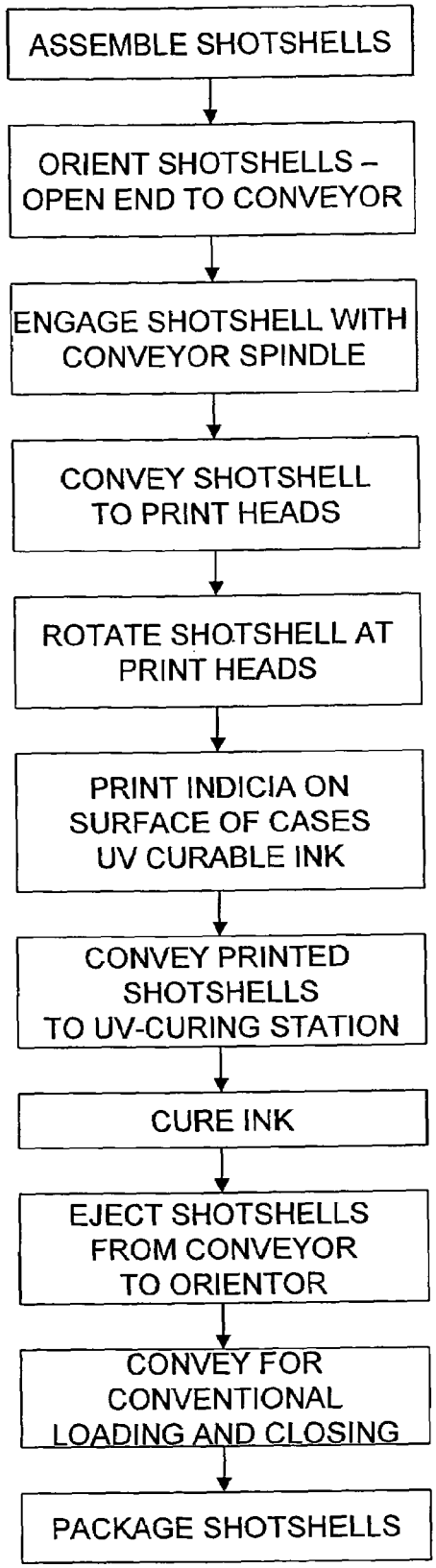
FIG. 6 is a flowchart illustrating an embodiment of the printing process according to FIG. 5*b* using a plurality of inkjet print heads, UV curable ink or solvent-based ink and a conveyor for conveying unload, assembled shotshell hulls and casings for printing and particularly to inkjet print a camouflage pattern on substantially the entire exterior of the shotshell.

In an embodiment of the invention, as outlined in FIG. 6, the entire outer surface 10 of the shotshell 1, including the case 3 and the hull 2, is sprayed using an inkjet printer head or a plurality of inkjet printer heads 20 for applying indicia, such as a camouflage pattern, to a substantial portion of the external surface 10 of the shotshell 1.

Figure 7:
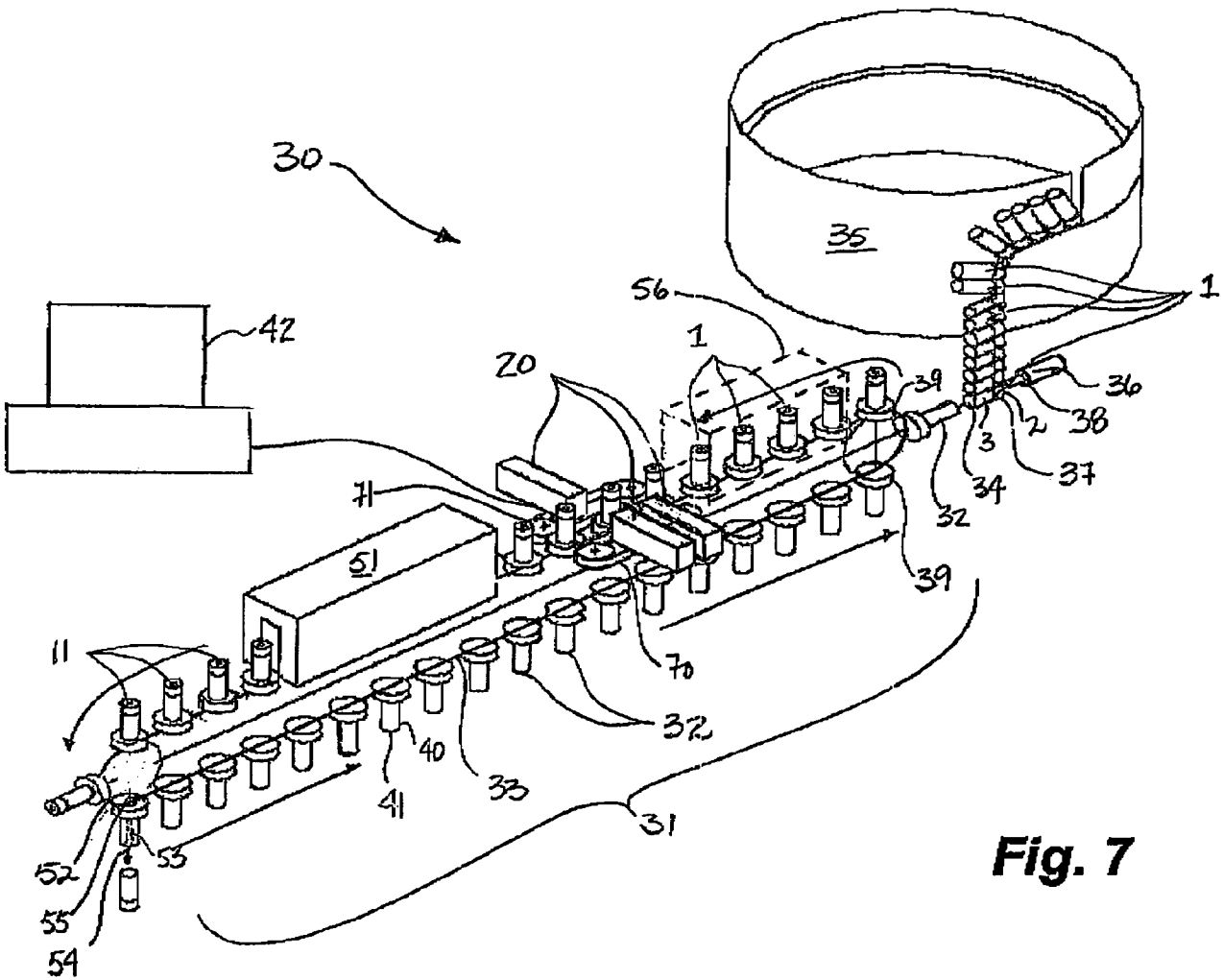
FIG. 7 is a schematic of an embodiment of apparatus operable to perform the printing process according to FIG. 6.

Having reference to FIG. 7, apparatus 30 is provided for incorporating the printing method using inkjet printer heads 20 into a typical shotshell 1 manufacturing stream. Following assembly of the cases 3 and hulls 2, the shotshells 1 are directed towards a conveyor 31 which picks up the assembled shotshells 1 and conveys the shotshells 1 for printing.

The conveyor 31 preferably consists of a plurality of individual spindles 32 rotatably connected to a conveyor belt 33 and protruding outwards therefrom. The shotshells 1 are oriented prior to reaching the conveyor 31, having an open end 34 of each shotshell 1 directed toward the conveyor 31. Typically, a hull orientor or bowl feeder 35 is used to orient the shotshells 1 in the desired direction. An electric eye 36 positioned adjacent an exit 37 from the hull orientor 35 ensures that the open end 34 of the shotshell case 3 is aligned with an individual spindle 32. When the case 3 and spindle 32 are aligned, an air jet 38 is released against the closed hull end 2 of the shotshell 1 to shoot the shotshell 1 onto the spindle 32. Each spindle 32 extends from a spindle base 39 which is rotatably attached to a conveyor 31. Rotation of the circular base member 39 and spindle 32 causes the attached shotshell 1 to co-rotate about an axis.

Preferably, a distal end 40 of each spindle 32 further comprises a magnet 41 which attracts the metal hull end 2 of the shotshell 1 causing the shotshell 1 to be held firmly to the spindle 32 as it is conveyed and rotated along the conveyor 31. The ratio of the speed of rotation of the spindle 32 and the conveyor belt 31 is such that the shotshell 1 is caused to rotate 360° about its axis and within a spray pattern from each of a plurality of inkjet printer heads 20 which are positioned adjacent the conveyor 31. As the shotshell 1 is rotated in front of the printer heads 20, a controller 42 causes each inkjet printer head 20 to spray pre-programmed indicia, such as a camouflage pattern or a portion of a camouflage pattern, onto the entire outer surface of the shotshell 1. Typically, three inkjet printer heads 20 are used to impart the camouflage pattern to the shotshell 1. The three printer heads 20 typically comprise a first which prints in yellow, a second which prints in cyan and a third which prints in magenta. Some camouflage patterns may require a fourth printer head which typically prints in black.

The controller 42, such as a computer, is used to control the spray pattern from each of the inkjet printer heads 20 using conventional print controller technology and a specific program containing the desired pattern co-ordinates. Further, the controller 42 is programmed to co-ordinate the speed of the conveyor 31 and the speed of rotation of the spindles 32.

Preferably, ink used in the inkjet printer heads 20 is a UV-curable ink. The resulting indicia printed onto the shotshells 1 is durable and not easily removed or abraded from the surface. Following spraying of the pattern onto the shotshell 1, the printed shotshell 1 is conveyed to a UV source 50 positioned inside a housing or curing tunnel 51 where the source of UV light 50 is directed to the external surface of the printed shotshell 1 for curing the ink thereon.

Following curing, the conveyor 31 transports the printed shotshells 11 to an exit 52 where the printed shotshells 11 are removed from the conveyor 31 and are incorporated into conventional loading and packaging apparatus.

Preferably, the spindle 32 further comprises a port 53 which extends through the spindle 32. As the spindle 32 reaches the exit 52, the port 53 in the spindle 32 is aligned with a jet of pressurized air 54. A mechanical valve 55 is caused to open, releasing the jet of air 54 through the port 53 in the spindle 32. The jet of pressurized air 54 overcomes the attraction of the magnet 41, causing the printed shotshell 11 to fall from the spindle 32 and into a bowl feeder (not shown) from which the printed shotshells 11 are fed to the conventional loading and packaging processes.

Alternatively, as shown in dotted lines in FIG. 7, a corona treatment unit 56, is positioned in advance of the ink jet print heads. The shotshells 1 receive the corona treatment according to conventional technology to improve adhesion to the surface of the shotshells 1 prior to being conveyed and rotated past the ink jet print heads 20. A solvent-based ink is used to spray the indicia onto the shotshells 1 as previously described and the shotshells 1 are then directed to conventional loading and closing apparatus without the need to undergo a curing process.

Figure 8:
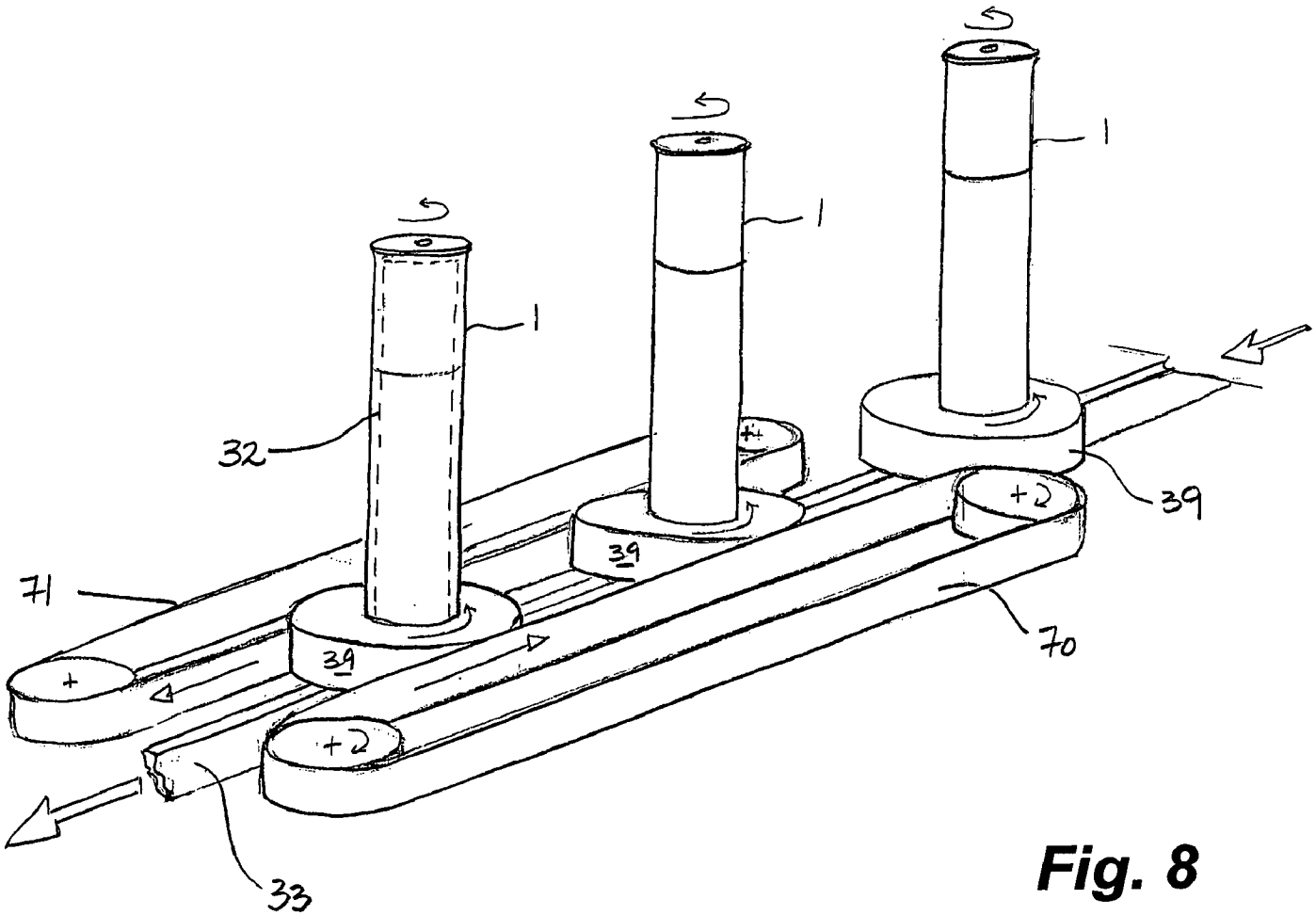
FIG. 8 is a partial perspective view according to FIG. 7, illustrating a pair of rotating belts for rotating shotshells carried by rotatable spindles as they pass adjacent a plurality of inkjet print heads for printing the entire surface of the shotshell, the print heads, seen in FIG. 7, having been removed to better view the rotating belt detail.
Figure 9:
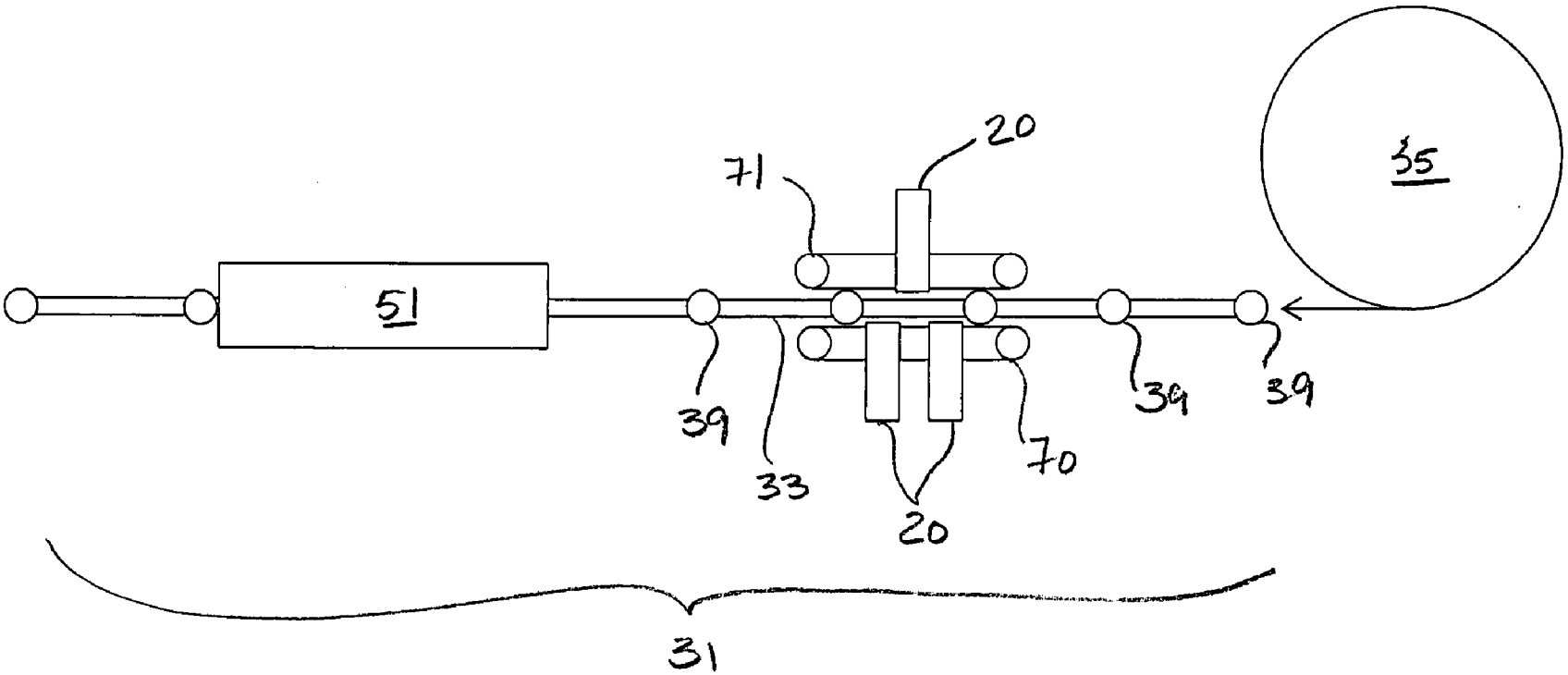
FIG. 9 is a schematic plan view of the apparatus according to FIG. 7.

As shown in greater detail in FIGS. 8 and 9 and in a preferred embodiment of the invention, a pair of corresponding rotating belts 70,71 is situated adjacent the print heads 20. One of the belts 70,71 is a drive belt 70 and the other is an idler belt 71. The belts 70,71 are positioned, one on either side of the conveyor belt 33 and are spaced so as to engage the spindle bases 39 therebetween as the conveyor 31 causes the spindles 32 and shotshells 1 to be conveyed to the print heads 20. The drive belt 70 is driven in an opposite direction to the conveyor belt 33 so as to cause each spindle base 39, spindle 32 and attached shotshell 1 to co-rotate therebetween. The idler belt 71 ensures that the spindle base 39 remains in contact with the drive belt 70 at all times. The speed of the drive belt 70 relative to the speed of the conveyor 31 is adjusted to cause the shotshell 1 to be rotated at least a full 360° at the print heads 20.

Figure 10A:
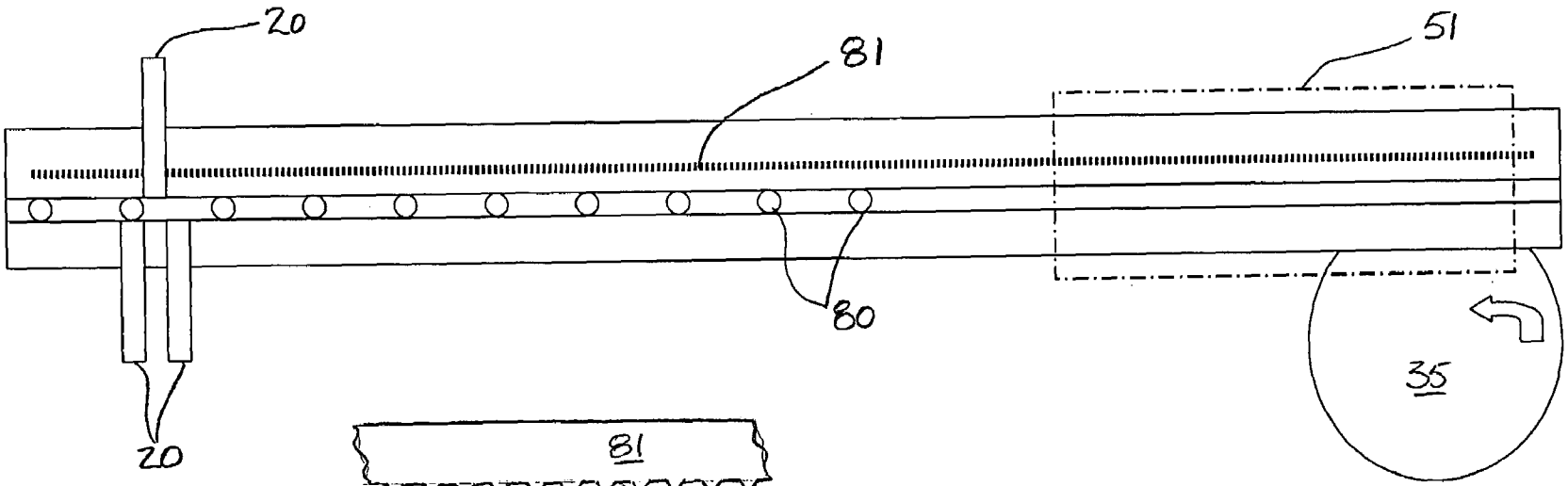
FIG. 10*a* is a plan view of an alternate embodiment operable to perform the printing process according to FIG. 6, the conveyor having a rack adjacent the print heads and geared rotatable pinions having spindles for engaging the rack and rotating the shotshells at the print heads.
Figure 10B:
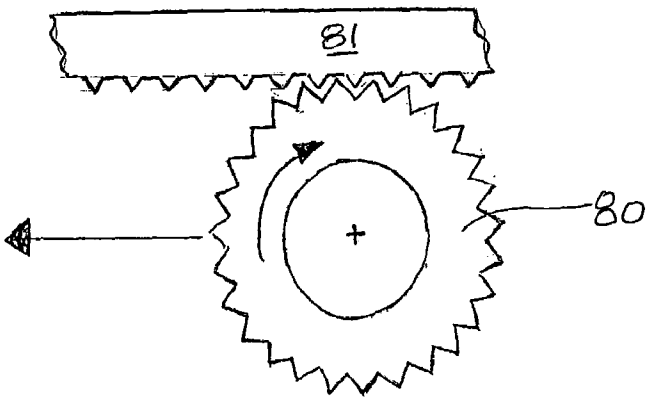
FIG. 10*b* is a detailed plan view illustrating the engagement of the geared rotatable pinions with the rack
Figure 10C:
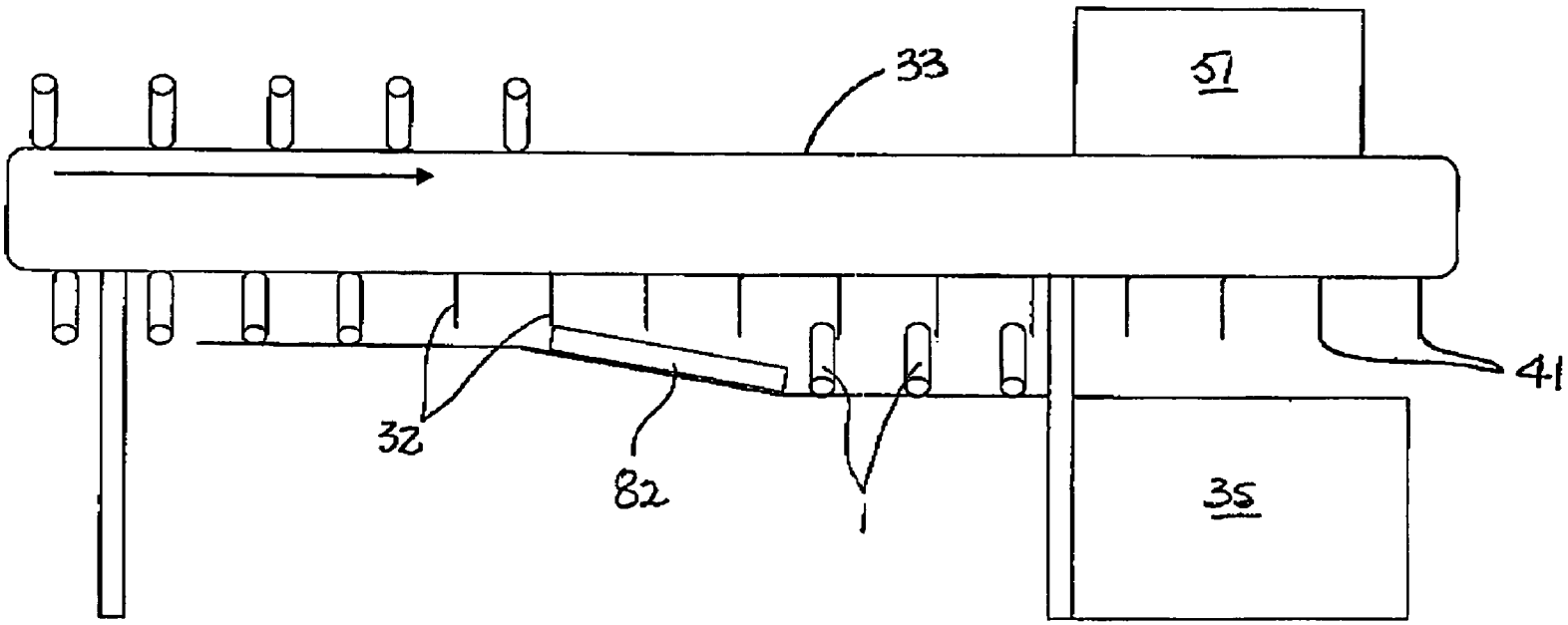
FIG. 10*c* is a side view according to FIG. 10*a;*

In another embodiment, as shown in FIGS. 10*a*–10*c*, the shotshells 1 are moved from the hull orientor 35 onto spindles 32 having geared bases or pinions 80. The pinions 80 engage a toothed rack 81 which acts to rotate the pinions 80 as they are conveyed by the continuous conveyor belt 33 to the printer heads 20 and to the curing tunnel 51. The ratio of the teeth in the rack 81 and teeth on the pinions 80 causes the spindles 32 and attached shotshells 1 to rotate at least a full 360° at the print heads 20, permitting printed about the entire outer surface 10 of the shotshells 1.

As shown in FIG. 10*c*, the hull orientor 35 is positioned below the curing tunnel 51. A timing screw 82 acts to align the shotshells 1 with the spindles 32 as the conveyor belt 33 moves from the hull orientor 35 to the print heads 20 positioned above. The shotshells 1 are retained on the spindles using magnets 41 and are ejected from the spindles 32 using the air jet (not shown), as previously described.

In an additional embodiment, the round bottom of the hull 2 is also sprayed, such as with a flat, non-glare ink.

In the case of preloaded ammunition, such as shotshells 1, means are provided in place of the spindles 32 to engage and rotate the shotshells 1. The means for engaging the loaded shotshell 1 may include such apparatus as means for gripping the shotshell 1, particularly at a base of the hull 2, magnetic means for attracting the metallic hull 2 to a rotatable base connected to the conveyor belt or means for sandwiching the shotshell therebetween and rotating the shotshell 1 for printing.

Figure 11:
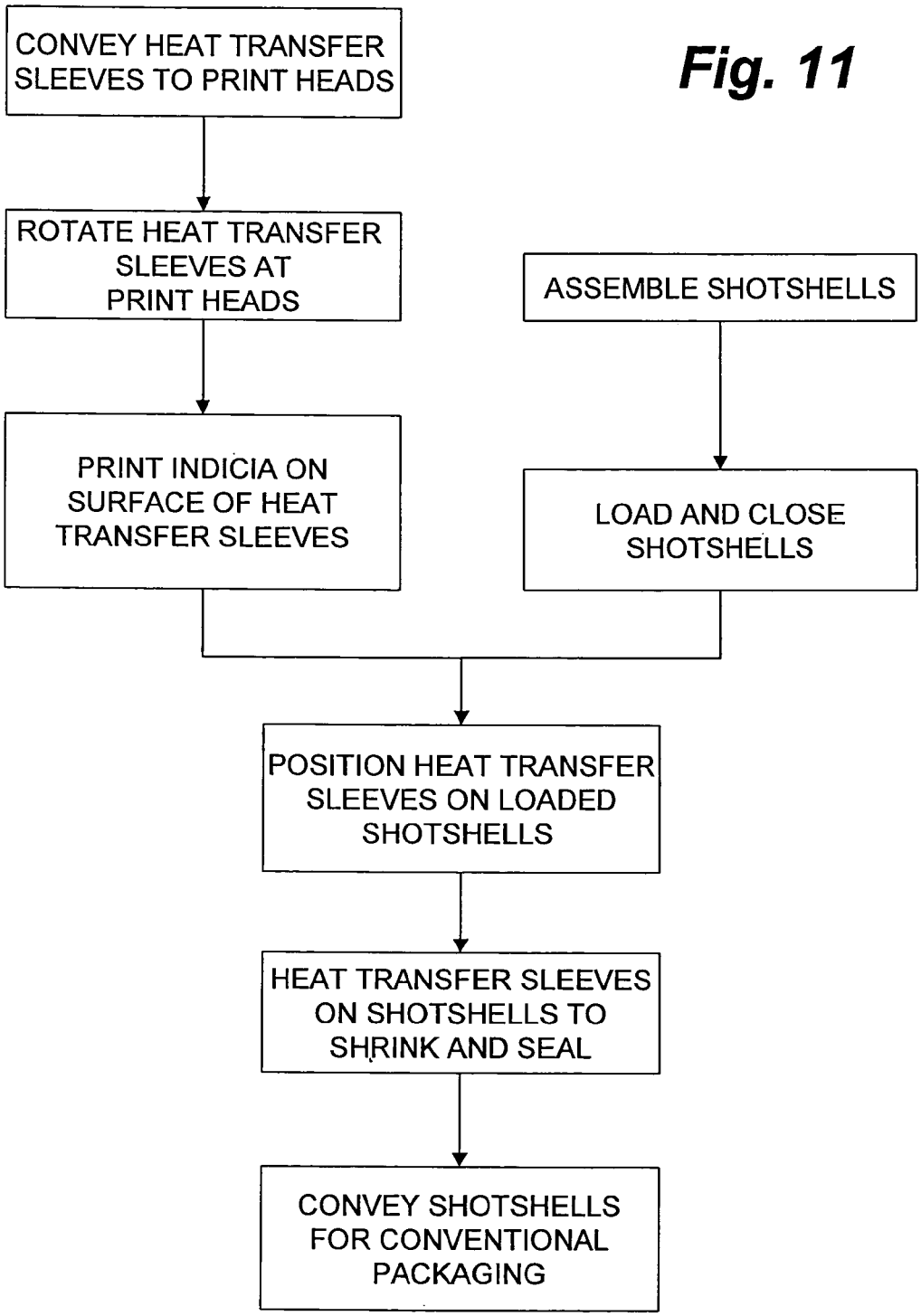
FIG. 11 is a flow chart illustrating an alternate embodiment of the invention in which heat transfer sleeves are pre-printed with indicia, using inkjet print heads, and subsequently heated onto shotshells for imparting indicia thereon.

As outlined in FIG. 11 and shown in FIG. 12 and in yet another alternate embodiment of the method of the invention, the camouflage pattern is imparted to the shotshell 1 using pre-printed heat transfer sleeves 100.

Heat shrinking film technology is known and is currently used for processing the surface of cylindrical objects such as soda cans and the like, as disclosed in EP 00689992 to Sukeyasu et. al. and EP 00017316 to Thawley et al. and incorporated herein by reference. Preprinted sleeves are placed over the cylindrical object and the film is then heated to cause shrinking of the film onto the surface of the object. Printing of the sleeve, preferably using a camouflage pattern, may be incorporated into the process or can be separately performed prior to heat shrinking.

Figure 12A:
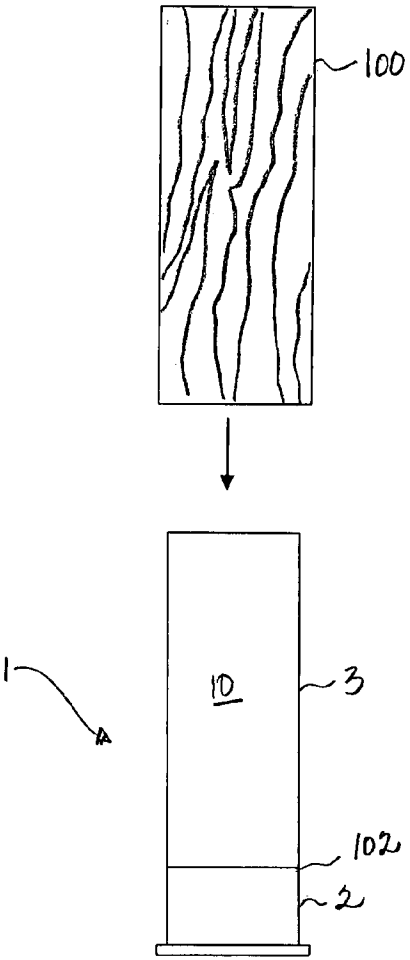
FIGS. 12*a*–12*c* are perspective views of an alternate printing process embodiment, more particularly
Figure 12B:
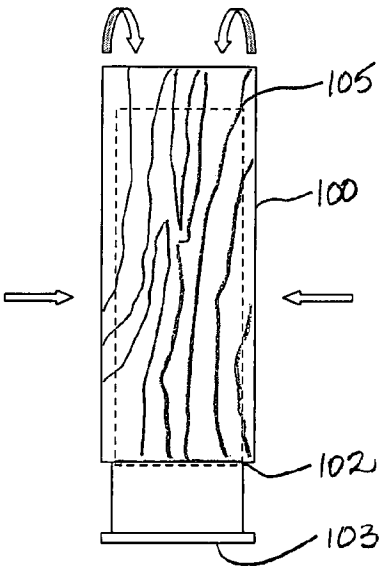
Figure 12C:
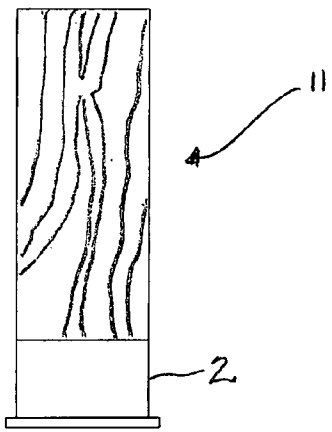

As shown in FIGS. 12*a*–12*c*, the thin film sleeve 100, to which the indicia has been imparted using fast drying and permanent ink, is placed over at least a portion of the case 3 and possibly, the hull 2. Preferably, at least one inkjet-type spray head is used to impart a non-glare, rapid drying ink to portions of the case 3 and/or hull 2 that are not covered by the sleeve 100. Sufficient heat (FIG. 12*b*) is applied to the sleeve 100 using established prior art techniques to cause the sleeve 100 to shrink and bond to the outer surface 10 of the shotshell 1. The temperature is monitored to ensure that the heat does not create a safety hazard with the explosive material in the shotshell 1 or other ammunition.

The sleeve 100 extends above a top 105 of the case 3 such that when the sleeve is heat-shrunk, the sleeve 100 shrinks and seals over the top 105 of the shotshell 1 adding additional water resistance or waterproofing to the shotshell 1. The remainder of the hull 2 is then sprayed with the rapid drying ink using the inkjet process to provide a non-reflective surface over the hull 2. Preferably, a bottom 103 of the hull 2 is also sprayed to reduce glare therefrom. More preferably, the sleeve 100 covers the entire case 3 and hull 2 to a rim 102 formed at the base of the hull 2.

In the case of shotshells 1 of varying lengths, optionally sleeves 100 of varying lengths are produced to cover the entire outer surface of the shotshells 1 or a single sleeve length is produced and applied to a portion of the case 3 only. The remainder of the surface, being typically the hull 2, but possibly including a portion of the case 3 for longer shotshell lengths, is sprayed using the inkjet process.

The invention claimed is:

1. Apparatus for printing indicia on an external surface of cylindrical shotshells having a case and a hull attached thereto and having an axis, comprising:

a plurality of inkjet print heads for spraying preprogrammed indicia on the shotshells;

a conveyor having a plurality of rotatable spindles projecting therefrom for insertion into and engagement of an open end of the shotshell case for rotatable conveyance thereof and for rotating the cylindrical shotshells about the shotshell's axis while traversing the plurality of inkjet print heads for printing the preprogrammed indicia thereabout;

means for orienting each shotshell to present the open end of the case to the spindle for engagement thereon; and a controller for causing the pre-programmed indica to be sprayed on the shotshells as the shotshells are rotated.

2. The apparatus as described in claim 1 wherein the inkjet print heads spray UV curable ink and further comprises:

a UV source for curing the UV-curable ink, wherein the UV source is positioned in a housing through which the printed shotshells are conveyed by the conveyor.

3. The apparatus as described in claim 1 wherein the preprogrammed indicia is a camouflage pattern.

4. The apparatus as described in claim 1 wherein the controller is a computer.

5. The apparatus as described in claim 1 wherein the spindles are carried rotatably on the conveyor for rotating the shotshells thereon.

6. The apparatus as described in claim 1 further comprising at least one drive belt, driven in an opposite direction to a direction of the conveyor, and operable to engage the rotatable spindles causing rotation thereof.

7. The apparatus as described in claim 6 further comprising a idler belt positioned on an opposing side of the conveyor to the drive belt to aid in engagement of the drive belt with the spindles positioned therebetween.

8. The apparatus as described in claim 1 further comprising a rack and wherein the spindles further comprise pinions for engaging the rack and rotating the spindles therebetween.

9. The apparatus as described in claim 1 wherein a distal end of each of the plurality of spindles further comprises a magnet for engaging a metal hull and attached case thereon.

10. The apparatus as described in claim 1 wherein the plurality of inkjet printer heads further comprises:

at least one printer head for printing yellow;

at least one printer head for printing cyan; and at least one printer head for printing magenta.

11. A method of applying indicia about an external surface of cylindrical ammunition comprising:

providing a plurality of ammunition;

orienting the ammunition for application of the indicia thereon;

applying the indicia to a substantial portion of an entire outer surface of the ammunition;

rotating the ammunition about an axis while applying the indicia; and controlling one or more ink jet print heads for applying the indicia to the substantial portion of the entire outer surface of the ammunition.

12. The method as described in claim 11, wherein the indicia is a camouflage pattern.

13. The method as described in claim 11 further comprising:

pre-treating the substantial portion of the entire outer surface of the ammunition using a corona treatment; and controlling one or more ink jet print heads for applying a the indica to the substantial portion of the entire outer surface of the ammunition using a solvent-based ink.

14. The method as described in claim 11 wherein the ammunition is a shotshell, each shotshell having a case and attached hull, the method further comprising:

orienting the shotshells so as to present an open end of the case to a conveyor spindle;

engaging the open end of the case with the conveyor spindle;

actuating the conveyor to cause the engaged shotshells to be rotatably passed adjacent a plurality of inkjet print heads;

actuating the inkjet print heads to spray ink for imparting the indica about substantially the entire external surface of each shotshell; and removing the shotshells from the conveyor.

15. The method according to claim 14 wherein the inkjet ink is UV curable ink and following actuating the inkjet printer heads to impart the indicia, further comprising:

exposing the shotshells to a UV source for curing the ink sprayed thereon.

16. The method as described in claim 11 wherein the indicia printed on the ammunition is a camouflage pattern.

17. The method as described in claim 16 wherein the inkjet print heads are actuated by a controller, the controller being programmed with the camouflage pattern.

18. The method as described in claim 16 further comprising:

applying non-glare ink to a portion of the ammunition left uncovered by the heat transfer sleeve.

19. The method as described in claim 16 wherein the indicia applied to the heat transfer sleeve is a camouflage pattern.

20. The method as described in claim 11 further comprising:

applying the indicia to a heat transfer sleeve;

positioning the heat transfer sleeve over at least a portion of the external surface of the ammunition; and applying sufficient heat to the heat transfer sleeve to cause the heat transfer sleeve to shrink and bond to the external surface of the ammunition.

21. A camouflaged ammunition comprising a substantially cylindrical outer surface, wherein indicia comprising at least a camouflage pattern is applied to substantially the entire outer surface.

22. The camouflaged ammunition as described in claim 21 wherein the indicia comprises:

a camouflaged pattern covering a portion of the outer surface; and a non-glare ink covering a remaining portion of the outer surface.

23. The camouflaged ammunition as described in claim 21 wherein the ammunition is a shotshell.

* * * * *